US005695825A

United States Patent [19]

Scruggs

[11] Patent Number: 5,695,825

[45] Date of Patent: Dec. 9, 1997

[54] TITANIUM-CONTAINING FERROUS HARD-FACING MATERIAL SOURCE AND METHOD FOR HARD FACING A SUBSTRATE

[75] Inventor: David M. Scruggs, Oceanside, Calif.

[73] Assignee: Amorphous Technologies International, Laguna Niguel, Calif.

[21] Appl. No.: 457,395

[22] Filed: May 31, 1995

[51] Int. Cl.[6] ..... C23C 4/06

[52] U.S. Cl. ..... 427/449; 427/451; 427/452; 427/456

[58] Field of Search ..... 427/449, 451, 427/452, 456

[56] References Cited

U.S. PATENT DOCUMENTS

| | | | |
|---|---|---|---|
| 3,332,752 | 7/1967 | Batchelor et al. | 29/191.6 |
| 4,396,820 | 8/1983 | Puschner | 219/121 ED |
| 4,725,512 | 2/1988 | Scruggs | 428/678 |
| 4,741,974 | 5/1988 | Longo et al. | 428/558 |
| 4,810,850 | 3/1989 | Tenkula et al. | 219/146.1 |
| 5,030,519 | 7/1991 | Scruggs et al. | 428/614 |
| 5,294,462 | 3/1994 | Kaiser et al. | 427/446 |

FOREIGN PATENT DOCUMENTS

| | | | |
|---|---|---|---|
| 58-27862 | 2/1983 | Japan | 427/451 |

*Primary Examiner*—Katherine A. Bareford
*Attorney, Agent, or Firm*—Gregory Garmong

[57] ABSTRACT

A hard-facing material source is an article whose net composition is, in weight percent, from about 20 to about 35 percent chromium, from about 2 to about 5 percent boron, from about 1 to about 2.5 percent silicon, from 0 to about 0.5 percent carbon, from about 0.5 to about 2 percent manganese, and from about 0.2 to about 1.0 percent titanium, balance iron and incidental impurities. The article may be a powder or a hollow tube with a powder packed therein. The hard-facing material source is thermally applied to a substrate by spraying or welding.

13 Claims, 3 Drawing Sheets

TITANIUM-CONTAINING FERROUS HARD-FACING MATERIAL SOURCE AND METHOD FOR HARD FACING A SUBSTRATE

BACKGROUND OF THE INVENTION

This application relates to the application of a hard, wear-resistant coating on a substrate, and, more particularly, to a hard-facing material and its use in the application of the coating to the substrate.

Strong, tough stem alloys are widely used as materials of construction. Such materials are typically not resistant to wear and are therefore not well suited for use in applications where the surface of the steel alloy is exposed to an abrasive environment. In one well-established approach, a hard-facing material is deposited onto the surface of the steel alloy substrate to act as a protective layer. The underlying steel substrate provides the strength required in the structure, and the hard-facing material protects the substrate against removal by wear in adverse environments. The hard-facing material also desirably protects the substrate against corrosion damage, as well. A wide variety of hard-facing materials are known, including, for example, ceramic-containing compositions such as rungsten carbide/cobalt and purely metallic compositions. The present invention relates to such metallic hard-facing materials and their utilization.

One class of metallic hard-facing materials is the frictionally transforming amorphous alloys generally disclosed in U.S. Pat. No. 4,725,512. These ferrous materials can be deposited upon the surface of a substrate as a hard-facing layer in their non-amorphous state, by techniques such as thermal spraying. When the hard-facing layer is subjected to wearing forces, such as abrasive wear, the deposited material transforms to the hard, wear-resistant amorphous state.

One problem encountered with some specific alloys within this class is that the hard-facing deposit, when applied by thermal spraying, may sometimes contain porosity and have through-cracks that extend perpendicular to the thickness direction of the coating. The porosity permits corrosive media to penetrate through the coating to the substrate and damage it by corrosion or stress corrosion. The through-cracks can lead to fracturing and spalling of the wear-resistant coating, which in mm results in the abrasive media reaching the substrate and rapid wear of the underlying substrate.

The hard-facing materials that exhibit such porosity and through cracking are otherwise excellent hard-facing materials. There is a need to overcome these problems in a manner which does not adversely affect the basic operability of these materials for hard-facing applications. The present invention fulfills this need, and further provides related advantages.

SUMMARY OF THE INVENTION

The present invention provides a hard-facing material source and a method for hard facing substrates using that material source. The hard-facing material source can be prepared in any of a number of useful forms, such as a powder or a welding rod, that can be used in available thermal spraying or other type of coating application equipment. The hard-facing deposit adheres to the substrate, has excellent wear-resistant properties, and provides corrosion protection for the substrate.

In accordance with the invention, a hard-facing material source comprises an article whose net composition is, in weight percent, from about 20 to about 35 percent chromium, from about 2 to about 5 percent boron, from about 1 to about 2.5 percent silicon, from 0 to about 0.5 percent carbon, from about 0.5 to about 2 percent manganese, and from about 0.2 to about 1.0 percent titanium, balance iron and incidental impurities. The material source article can be, for example, a powder, or a hollow tube and powder packed therein whose net composition is as stated.

In one preferred embodiment, the material source article has a net composition of from about 25 to about 28 percent chromium, from about 3.8 to about 4.1 percent boron, from about 1.3 to about 1.8 percent silicon, from about 1.2 to about 1.6 percent manganese, and from about 0.4 to about 0.9 percent titanium, balance iron and incidental impurities including carbon. (In this embodiment, no carbon is intentionally added, but there may be minor amounts of carbon present from the sources of the other constituents.)

In another embodiment, the material source article further comprises, in weight percent, from about 0.1 to about 10 percent nickel, from about 0.1 to about 8 percent molybdenum, and from about 0.1 to about 3 percent copper. A preferred composition of this type is from about 22 to about 23 percent chromium, from about 2.3 to about 2.6 percent boron, from about 1.0 to about 2.0 percent silicon, from about 0.5 to about 1.2 percent manganese, from about 0.4 to about 0.9 percent titanium, from about 4.6 to about 8.0 percent nickel, from about 3.7 to about 4.2 weight percent molybdenum, and from about 2.0 to about 2.3 percent copper, balance iron and incidental impurities including carbon. (Again, no carbon is added, but there may be minor amounts of carbon present from the sources of the other constituents.).

These material sources are preferably applied by a thermal deposition technique appropriate for the form of the material source. For material source powders, the powder is preferably applied by thermal spraying or powder welding. For material sources of rods with powder packed therein, typically termed hard-facing rods, the application technique is preferably thermal spraying or welding. Most preferably, the hard-facing rod is applied by electric-arc spraying. In this technique, the hard-facing rod is progressively introduced into an electric arc, wherein it is heated and at least partially melted. The heated material is propelled toward the substrate by a gas jet. The electric arc is most preferably formed between two of the hard-facing rods.

The presence of a small amount of titanium in the net composition of the material source, from about 0.2 to about 1.0 weight percent titanium, has been found to beneficially reduce the porosity and through-cracking otherwise found in the resulting hard-facing depositions produced from these source materials. As a result, the hard-facing deposit is more dense, resistant to corrosive penetration, and resistant to cracking than in the absence of the titanium. The hard-facing layer retains its excellent wear resistance.

Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
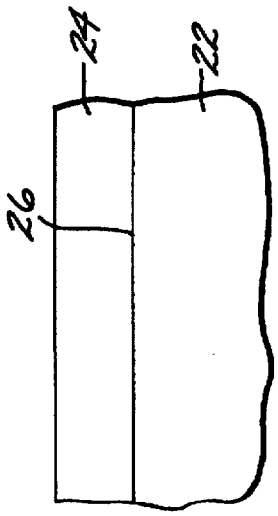
FIG. 1 is a side elevational view of a hard-faced substrate.

FIG. 1 depicts a hard-faced article 20 prepared by the approach of the invention. The article 20 includes a substrate 22 that is typically iron, steel, or aluminum, but can be any other operable material as well. It is coated with a hard-facing layer 24 that is bonded to a surface 26 of the substrate 22. In service, the hard-facing layer 24 is exposed to a wear-inducing and/or corrosive environment.

Figure 2:
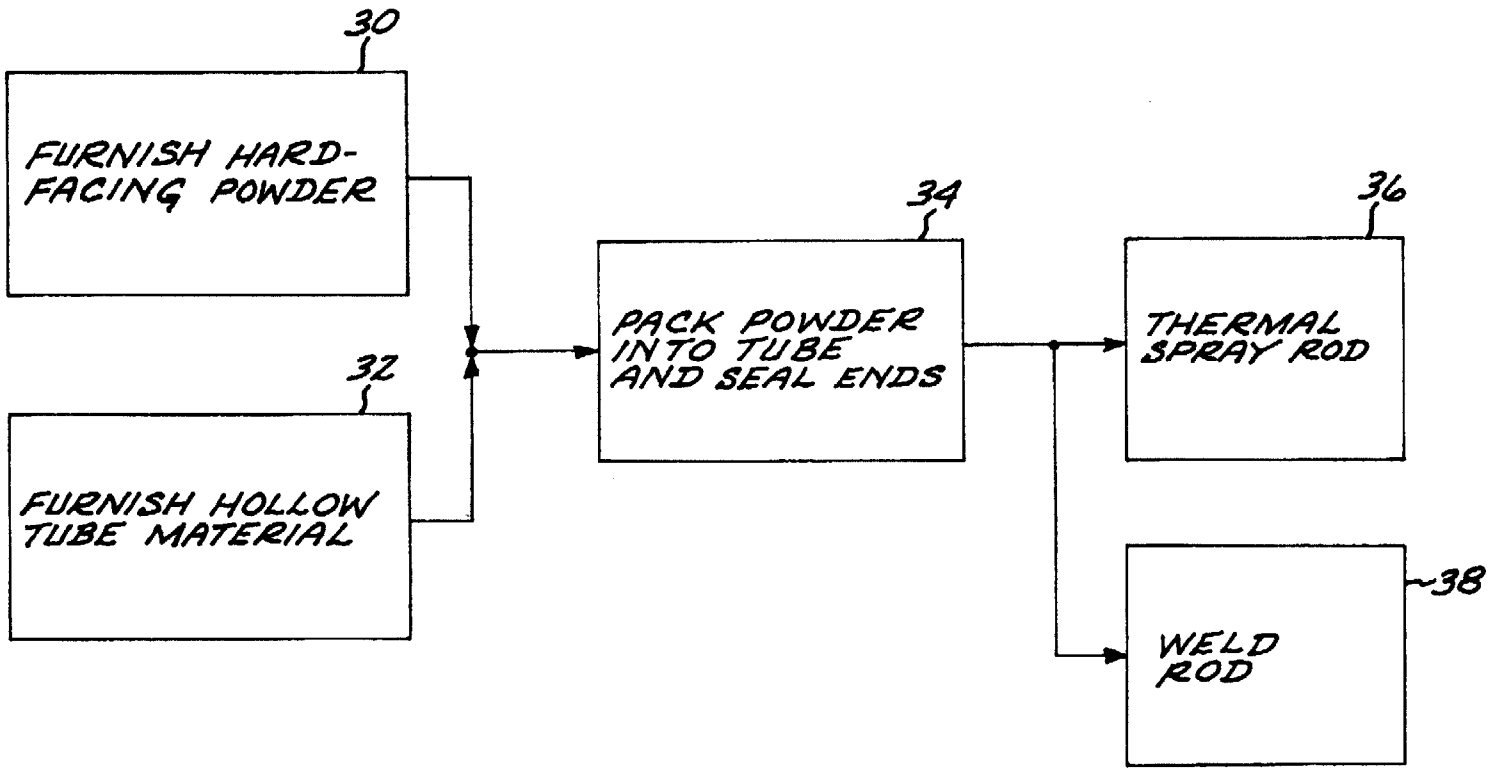
FIG. 2 is a block diagram of a method for hard facing the substrate using a hard-facing rod material source.

FIG. 2 illustrates one form of the approach of the invention. A hard-facing powder is first prepared and famished, numeral 30, and a hollow tube is furnished, numeral 32. The hollow tube 32 is preferably made of steel with a size suitable for the particular technique chosen for applying the hard-facing layer 24 to the substrate 22. In the preferred embodiment, the hollow tube is a hollow wire with an inner diameter of 0.040 inches and an outer diameter of 0.062 inches. Equivalently for the present purposes, the "hollow tube" can be initially furnished as a strip of metal, preferably about 0.009 inches to about 0.015 inches thick. The tube is formed during the subsequent processing, as shown in U.S. Pat. No. 4,396,820, whose disclosure is incorporated by reference.

The powder can be a prealloyed powder, or a mixture of powders that melt together to contribute to forming the desired net composition, such as ferrosilicon, ferromolybdenum, ferroboron, ferrotitanium, chromium, and/or low-carbon ferrochromium in the required proportions. The powder size is selected according to the application technique to be used. The powder size is typically −60/+325 mesh or −80/+325 mesh, but could be other sizes as well. Some or all of the constituents of the powder can be supplied as prealloyed constituents such as ferrosillcon, ferromolybdenum, ferroboron, ferrotkanium, or low-carbon ferrochromium, as indicated. Such prealloyed constituents are available commercially at reasonable cost in most cases, and their use helps to achieve a low cost and good microstructure for the final product. However, such prealloyed constituents may contain impurities such as carbon. Such impurities in minor amounts are tolerated in the hard facings prepared in accordance with the invention.

The composition and dimension of the hollow tube, and the composition of the powder, are cooperatively selected so that the net composition is from about 20 to about 35 percent chromium, from about 2 to about 5 percent boron, from about 1 to about 2.5 percent silicon, from 0 to about 0.5 percent carbon, from about 0.5 to about 2 percent manganese, and from about 0.2 to about 1.0 percent titanium, balance iron and incidental impurities. As used herein, the "net composition" is defined as the total composition that takes into account both the composition and amount of hollow tube material and the composition and amount of powder that is packed into the tube. Because the tube material and the powder material are melted or partially melted together during the application step, it is this net composition which reaches the surface of the article to form the layer 24 that is of most significance.

The hard-facing powder is packed into the hollow tube and the tube is sealed, numeral 34. Where the tube is relatively large in size, the powder can be packed into the tube and the ends sealed as by mechanical crimping. Where the tube is relatively small in size, as in the case of the 0.062 inch diameter wire used in the preferred deposition technique, the powder is placed along the center of a strip of the material used in the tube, the strip is folded into a tube configuration, and the edges of the strip are welded together along their lengths to form a tube packed with powder as shown in the '820 patent.

Figure 3:
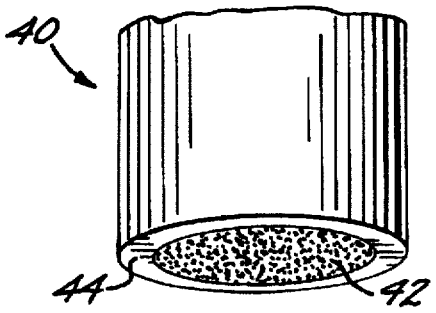
FIG. 3 is a perspective view of a sectioned hard-facing rod.

FIG. 3 depicts a hard-facing rod 40 prepared by the steps 30, 32, and 34. The hard-facing rod 40 includes the hard-facing powder 42 packed within the interior of the hollow tube 44.

The invention includes some particularly preferred net compositions that can be used in various applications. In one preferred embodiment, the net composition of the hard-facing rod 40 is from about 25 to about 28 percent chromium, from about 3.8 to about 4.1 percent boron, from about 1.3 to about 1.8 percent silicon, from about 1.2 to about 1.6 percent manganese, and from about 0.4 to about 0.9 percent titanium, balance iron and incidental impurities including carbon. The hollow tube 44 in this case is preferably formed of a steel having substantially no nickel therein, such as S43000 ferritic stainless steel.

In another embodiment, the net composition can include nickel, molybdenum, and copper. A preferred net composition of this type is from about 20 to about 35 percent chromium, from about 2 to about 5 percent boron, from about 1 to about 2.5 percent silicon, from 0 to about 0.5 percent carbon, from about 1 to about 2 percent manganese, from about 0.1 to about 10 percent nickel, from about 0.1 to about 8 percent molybdenum, and from about 0.1 to about 3 percent copper, from about 0.2 to about 1.0 percent titanium, balance iron and incidental impurities. A particularly preferred net composition of this type is from about 22 to about 23 percent chromium, from about 2.3 to about 2.6 percent boron, from about 1.0 to about 2.0 percent silicon, from about 0.5 to about 1.2 percent manganese, from about 4.6 to about 8.0 percent nickel, from about 3.7 to about 4.2 weight percent molybdenum, and from about 2.0 to about 2.3 percent copper, from about 0.4 to about 0.9 percent titanium, balance iron and incidental impurities such as carbon. In this case, the hollow tube is preferably a nickel-chromium stainless steel such as S30400 or S30403.

Figure 4:
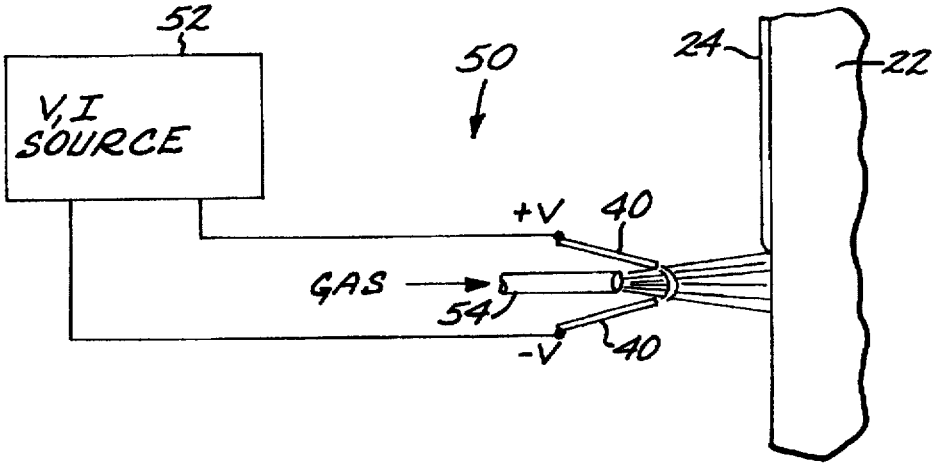
FIG. 4 is a schematic illustration of a twin-wire arc spray apparatus used in hard facing the substrate.

The hard-facing rod 40 formed by the steps 30, 32, and 34 is thermally sprayed onto the substrate 22, numeral 36, preferably by an electrical arc spray process, and most preferably by twin wire arc spraying (TWAS). The TWAS process is known in the art, and apparatus for performing TWAS is available commercially. FIG. 4 is a schematic depiction of such a TWAS apparatus 50. The tips of two of the hard-facing rods 40 are brought together, while a voltage is applied between the rods 40 by a voltage and current source 52. The applied current flowing through the tips of the rods 40 causes the tips to at least partially melt. A current of gas such as air or nitrogen is flowed at a high rate from a gas source 54 through the melted metal of the rods 40. The metallic material is directed against the substrate 22. In FIG. 4, the substrate 22 has been partially covered by a deposit of the hard-facing layer 24. Additional material is deposited by moving the TWAS apparatus 50 parallel to the substrate 22, or equivalently moving the substrate 22 parallel to the apparatus 50.

The hard-facing rod 40 formed by steps 30, 32, and 34 can also be applied to the substrate by other operable thermal techniques. One such other technique of interest is welding, numeral 38, wherein the surface 26 is heated to form a molten pool, as with an oxyacetylene torch. The hard-facing rod is fed into the molten pool, where it melts, co-mixes with the small mount of molten metal from the substrate 22, and freezes as the layer 24 when the heat is removed in an area. The result is a hard-faced substrate as illustrated in FIG. 1.

Figure 5:
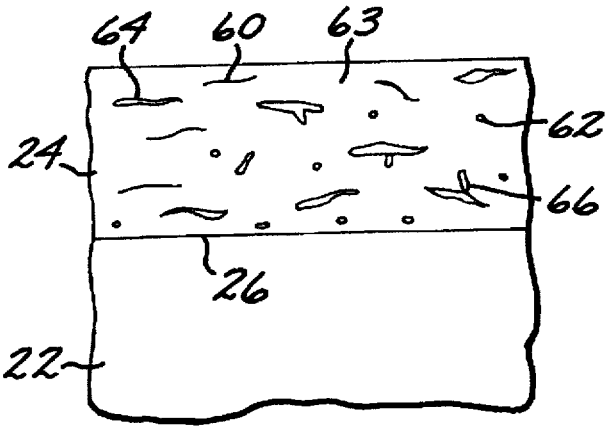
FIG. 5 is a drawing of an idealized microstructure of a hard-facing deposit having no titanium.
Figure 6:
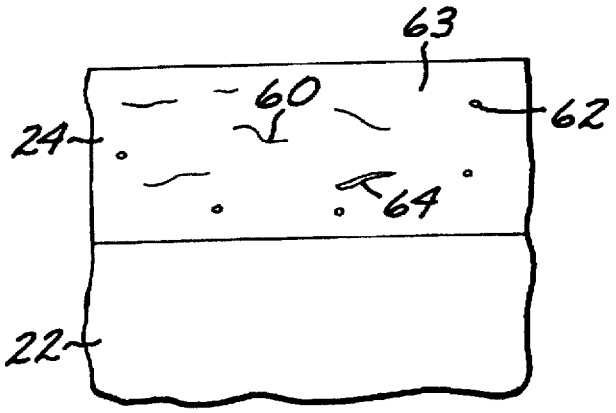
FIG. 6 is a drawing of an idealized microstructure of a hard-facing deposit having a titanium content within the range of the invention.
Figure 7:
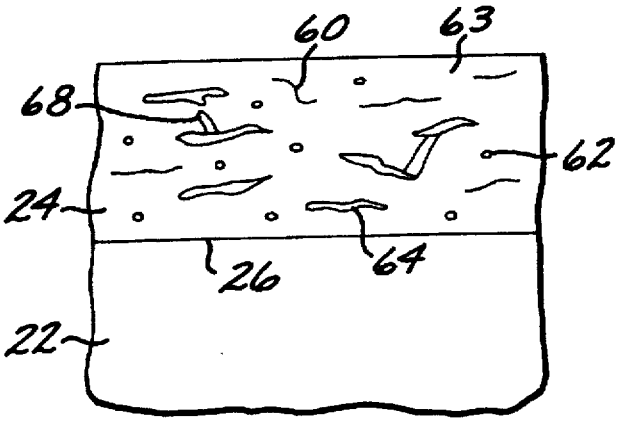
FIG. 7 is a drawing of an idealized microstructure of a hard-facing deposit having a titanium content above the range of the invention.

An important feature of the invention is the titanium content of the net composition. The titanium content of the net composition is from about 0.2 to about 1.0 percent by weight, and is preferably provided as titanium present in the powder 42. FIGS. 5–7 schematically illustrate the microstructures obtained by thermally spraying net compositions that are similar except for the titanium content.

If the net composition has no titanium, a microstructure like that of FIG. 5 results. Oxide streamers 60 and pores 62 are distributed through a metallic matrix 63, with the major part of the oxide streamers oriented generally parallel to the surface 26 of the substrate 22. It would be desirable that the oxide streamers 60 remain closed. However, in many cases the oxide streamers 60 form elongated voids 64 that are oriented generally parallel to the surface 26. These voids 64 are potentially harmful in three ways. First, they can serve as sites of mechanical failure of the hard-facing layer 24 during service. Second, the voids 64 and pores 62 can together provide a path for corrosive substances in the operating environment to reach the surface 26 and contribute to premature corrosive failure of the substrate 22. Tests have shown the presence of such continuous porosity in these hard-facing layers. Third, in many instances, small secondary cracks 66 extending generally perpendicular to the surface 26, and therefore also termed "through-thickness cracks", form in association with the voids 64. These secondary cracks can lead to even earlier failure of the substrate during service.

It has been found that a small, controlled addition of titanium to the net composition can suppress the formation of these defects and lead to improved strength and corrosion resistance of the substrate. FIG. 6 illustrates the microstructure resulting from spray application of the hard-facing rod when from about 0.2 to about 1.0 percent by weight of titanium is present in the net composition. A reduced number of oxide streamers 60 and pores 62 are present in the structure. Very few of the oxide streamers 60 result in voids 64, and substantially no secondary cracks 66 are present. Tests have demonstrated that there is not a continuous porosity reaching through the hard-facing layer 24 from the external environment to the substrate 22, so that corrosive media cannot reach the substrate. The greatly reduced number of voids 64 and secondary cracks 66 lead to less reduction in the strength of the hard-facing layer, as compared with the zero-titanium structure as shown in FIG. 5.

FIG. 7 illustrates the microstructure resulting from higher titanium contents, on the order of several percent, in the net composition. Oxide streamers 60 and pores 62 are present in a greater concentration. More of the oxide streamers 60 have developed into voids 64. Additionally, many of the secondary cracks 66 extend between voids 64 as bridging secondary cracks 68. This structure is highly susceptible to premature cracking of the hard-facing layer and penetration of corrosive liquids from the environment to the substrate 22.

From such studies, it is concluded that the advantageous structure of FIG. 6 is found in samples having from about 0.2 to about 1.0 weight percent titatitanium in the net composition. The less desirable structure of FIG. 5 is observed when the titanium content of the net composition is less than about 0.2 percent, and the less desirable structure of FIG. 7 is observed when the titanium content of the net composition is more than about 1.0 percent.

Table I presents the results of a series of tests illustrative of the approach and conclusions just discussed. Samples of steel substrate were coated using the TWAS technique. The hard-facing rod (wire) had an outside diameter of about 0.062 inches, and the net composition of the hard-facing powder and hollow tube was as indicated for each example in Table I. The hard-facing layer was deposited to the thickness indicated in Table I using a TAFA Co. Model 8830 TWAS deposition gun. The deposition parameters were a voltage of 34 volts, a current of 225 amps, 60 pounds per square inch air pressure, a distance from the deposition gun to the substrate of 5 inches, and a deposition mass flow of about 25–30 pounds per hour. In Table I, the "Composition" is given in weight percent of the net composition, with the balance iron and incidental impurities. A dash (—) means that none of the element was present in that composition. "Thickness" is the thickness of the hard-facing layer in thousandths of an inch (mils) and "Microstructure" is the type of microstructure found in the hard-facing layer by reference to FIG. 5, FIG. 6, or FIG. 7.

TABLE I

| | Net Composition, weight percent | | | | | | | | Thickness | Microstructure |
|---|---|---|---|---|---|---|---|---|---|---|
| Example | Cr | B | Si | Mn | Ni | Mo | Cu | Ti | (mils) | FIG. No. |
| 1 | 27 | 3.7 | 1.8 | 1.6 | — | — | — | 0.84 | 40 | 6 |
| 2 | 22 | 2.3 | 2.0 | 0.7 | 5.3 | 3.7 | 2.0 | 0.49 | 40 | 6 |
| 3 | 28 | 3.8 | 1.8 | 1.6 | — | — | — | — | 40 | 5 |
| 4 | 23 | 2.3 | 1.0 | 1.2 | 8.0 | 3.7 | 2.0 | — | 40 | 5 |
| 5 | 25 | 4.1 | 1.2 | 1.2 | — | — | — | 2.5 | 20 | 7 |
| 6 | 22 | 2.6 | 2.0 | 0.5 | 4.6 | 4.2 | 2.3 | 3.0 | 20 | 7 |

Figure 8:
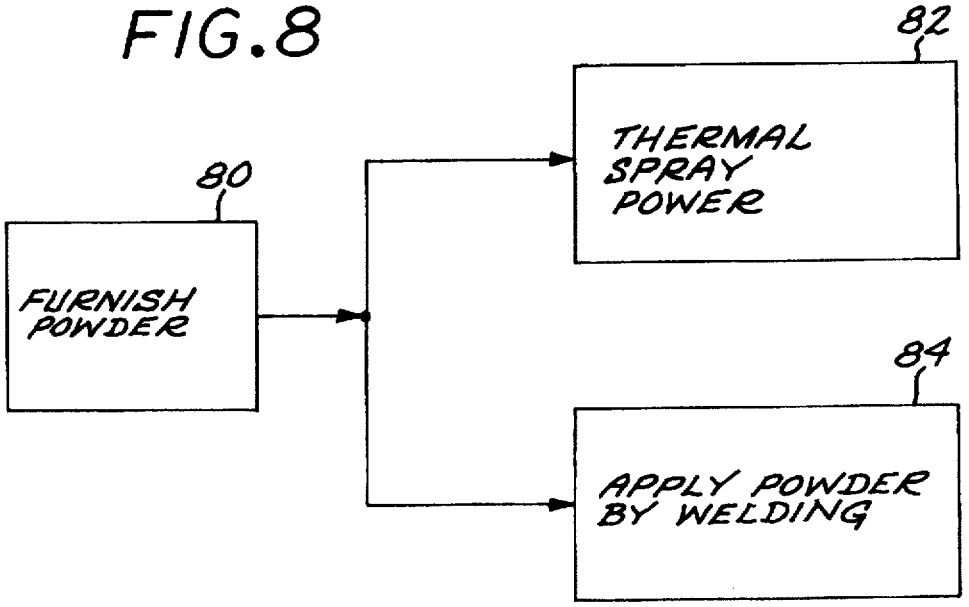
FIG. 8 is a block diagram of a method for hard facing the substrate using a powder material source.

The invention can also be practiced using a powder alone as the hard-facing material source. That is, no hollow tube is present. The preceding discussion regarding general and preferred "net compositions" and results is equally applicable to this material source and its associated application procedures, and is incorporated here, except that here "net composition" relates only to the composition of the powder material source. Referring to FIG. 8, the powder is furnished, numeral 80. The powder by itself has the net composition or preferred net composition discussed previously, and is typically furnished as a prealloyed powder. Because there is no steel tube to be considered in describing the net composition, the composition of the powder used in this approach is typically higher in iron than the composition of the powder used in the approach of FIG. 2. The preferred powder size is selected according to the application procedure that is to be used. For application by high-velocity oxygen fuel thermal spray, the powder size is preferably −325/+10 micrometers mesh. For application by plasma transfer arc welding, the powder size is preferably −80/+150 mesh.

The powder is applied by any operable technique, and either of two such operable techniques is preferred. The powder may be applied by thermal spray such as high-velocity oxygen fuel thermal spray, numeral 82, or plasma transfer arc welding, numeral 84. These two techniques are well known in the art.

The result of the approach of FIG. 8 is a coated substrate of the type illustrated in FIG. 1.

The present invention thus provides an approach for hard facing a substrate wherein the quality and performance of the hard facing are improved by maintaining the titanium content of the hard-facing net composition within specific limits. Both too little or too much titanium lead to less-desirable structures and properties of the coating. Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for hard facing a substrate, comprising the steps of:

furnishing an article whose net composition is, in weight percent, from about 20 to about 35 percent chromium, from about 2 to about 5 percent boron, from about 1 to about 2.5 percent silicon, from 0 to about 0.5 percent carbon, from about 0.5 to about 2 percent manganese, and from about 0.2 to about 1.0 percent titanium, balance iron and incidental impurities; and thermally applying the article to the substrate as a coating.

2. The method of claim 1, wherein the step of furnishing an article includes the step of furnishing a powder having the net composition recited in claim 1.

3. The method of claim 1, wherein the step of famishing an article includes the step of furnishing a hollow metallic tube and a powder packed therein, the tube and the powder together having the net composition recited in claim 1.

4. The method of claim 1, wherein the step of thermally applying includes the step of thermally spraying the article onto the substrate.

5. The method of claim 1, wherein the step of thermally applying includes the step of applying the article onto the substrate by welding.

6. The method of claim 1, wherein the step of furnishing an article includes the step of furnishing a hard-facing rod comprising a hollow metallic tube and a powder packed therein, the tube and the powder together having the net composition recited in claim 1, and wherein the step of thermally applying includes the step of heating the hard-facing rod in an electric arc to at least partially melt the hard-facing rod, and propelling the at least partially melted hard-facing rod toward the substrate using a gas jet.

7. The method of claim 1, wherein the step of furnishing an article includes the step of furnishing an article having a net composition, in weight percent of from about 25 to about 28 percent chromium, from about 3.8 to about 4.1 percent boron, from about 1.3 to about 1.8 percent silicon, from about 1.2 to about 1.6 percent manganese, and from about 0.4 to about 0.9 percent titanium, balance iron and incidental impurities.

8. A method for hard facing a substrate, comprising the steps of:

furnishing an article whose net composition is, in weight percent, from about 20 to about 35 percent chromium, from about 2 to about 5 percent boron, from about 1 to about 2.5 percent silicon, from 0 to about 0.5 percent carbon, from about 0.5 to about 2 percent manganese, from about 0.2 to about 1.0 percent titanium, from about 0.1 to about 10 percent nickel, from about 0.1 to about 8 percent molybdenum, and from about 0.1 to about 3 percent copper, balance iron and incidental impurities; and thermally applying the article to the substrate as a coating.

9. The method of claim 8, wherein the step of furnishing an article includes the step of furnishing an article having a net composition, in weight percent, of from about 22 to about 23 percent chromium, from about 2.3 to about 2.6 percent boron, from about 1.0 to about 2.0 percent silicon, from about 0.5 to about 1.2 percent manganese, from about 0.4 to about 0.9 percent titanium, from about 4.6 to about 8.0 percent nickel, from about 3.7 to about 4.2 percent molybdenum, and from about 2.0 to about 2.3 percent copper, balance iron.

10. The method of claim 8, wherein the step of furnishing an article includes the step of furnishing a powder having the net composition recited in claim 8.

11. The method of claim 8, wherein the step of furnishing an article includes the step of furnishing a hollow metallic tube and a powder packed therein, the tube and the powder together having the net composition recited in claim 8.

12. The method of claim 8, wherein the step of thermally applying includes the step of thermally spraying the article onto the substrate.

13. The method of claim 8, wherein the step of thermally applying includes the step of applying the article onto the substrate by welding.

* * * * *